US005197426A

United States Patent [19]

Frangesch et al.

[11] Patent Number: 5,197,426

[45] Date of Patent: Mar. 30, 1993

[54] INTEGRAL ENGINE HOUSING

[75] Inventors: Richard Frangesch, Elm Grove; Scott Funke, New Berlin, both of Wis.

[73] Assignee: Briggs & Stratton Corporation, Wauwatosa, Wis.

[21] Appl. No.: 878,552

[22] Filed: May 5, 1992

[51] Int. Cl.[5] ..... F02R 77/00

[52] U.S. Cl. ..... 123/198 E

[58] Field of Search ..... 123/41.56, 41.63, 41.65, 123/41.7, 198 E

[56] References Cited

U.S. PATENT DOCUMENTS

| | | | |
|---|---|---|---|
| 4,051,648 | 10/1977 | Uhlinger et al. | 56/255 |
| 4,064,680 | 12/1977 | Fleigle | 56/11.9 |
| 4,194,345 | 3/1980 | Pioch et al. | 56/11.9 |
| 4,510,739 | 4/1985 | Dluhosch | 123/41.7 |
| 4,711,077 | 12/1987 | Kutsukake et al. | 56/320 |
| 4,771,603 | 9/1988 | Nagashima | 123/41.7 |
| 5,070,829 | 12/1991 | Guntly et al. | 123/179.9 |

FOREIGN PATENT DOCUMENTS 2006643 8/1971 Fed. Rep. of Germany .

*Primary Examiner*—Noah P. Kamen

*Attorney, Agent, or Firm*—Andrus, Sceales, Starke & Sawall

[57] ABSTRACT

An integral plastic engine housing is disclosed for small internal combustion engines such as those used on lawnmowers, snowblowers, generators and the like. The integral plastic housing integrates the blower housing, air filter housing, fuel tank, starter rewind housing, carburetor, primer bulb assembly and brake cover into a single unit to reduce the manufacturing and assembly costs. In a preferred embodiment, a plastic carburetor is connected to the remainder of the integral plastic housing via a pair of rails and corresponding slide members. The position of the carburetor with respect to the fuel tank and the air filter housing allows the air filter housing and fuel tank to be directly connected to the carburetor without the need for intervening hoses or lines and their associated clamps. The integral housing is substantially made from a polyethylene plastic material, with the carburetor and parts of the primer bulb assembly being preferably made from nylon.

30 Claims, 4 Drawing Sheets

FIG. 2
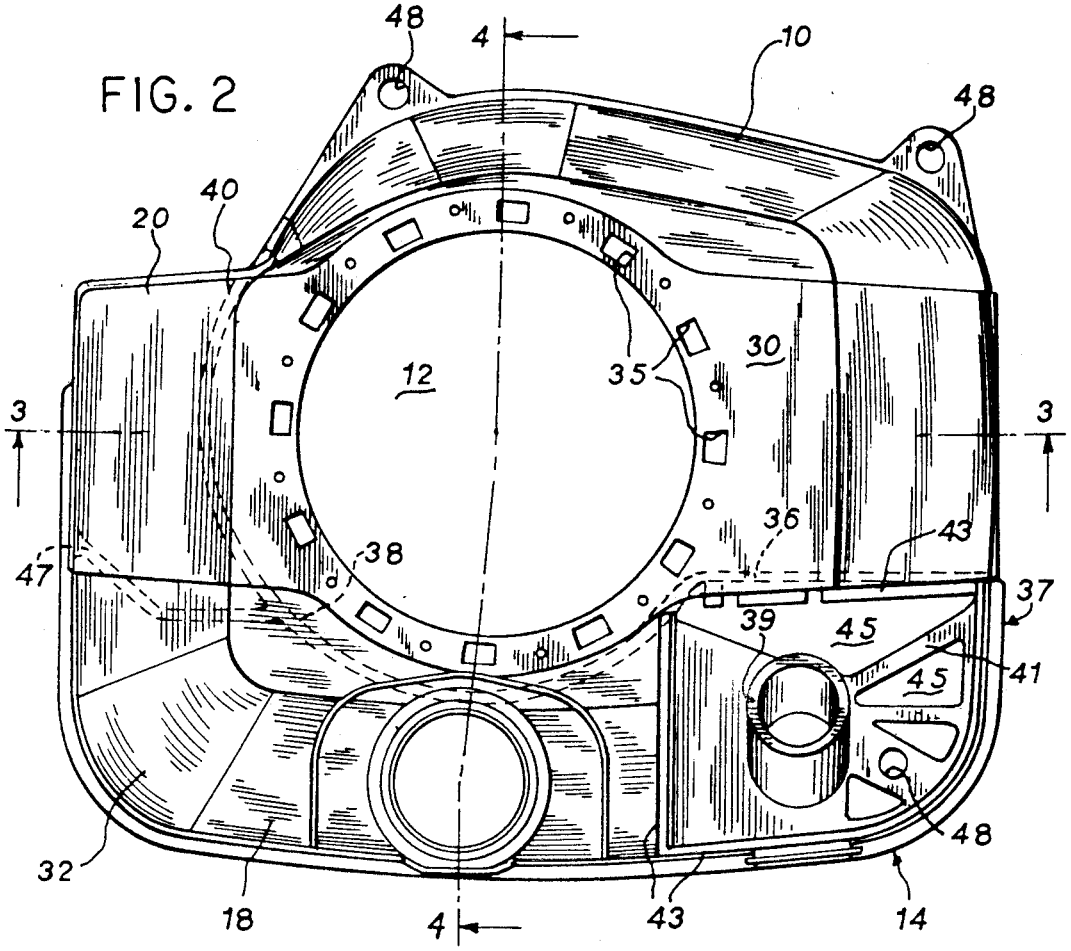
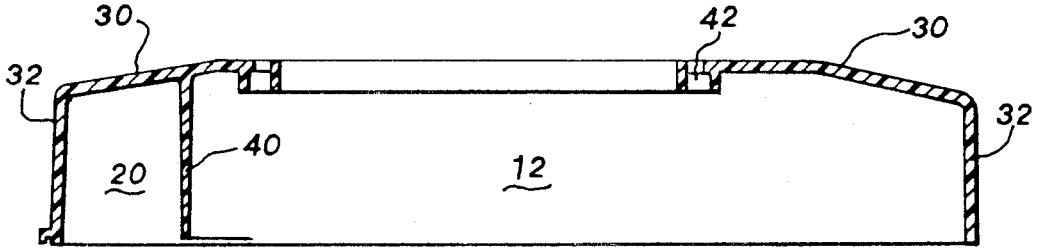
FIG. 3

FIG. 7
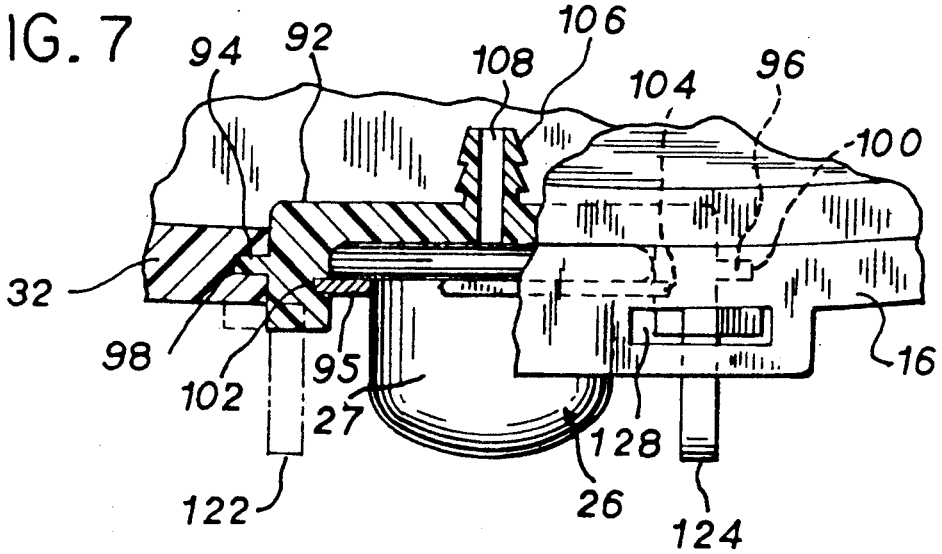
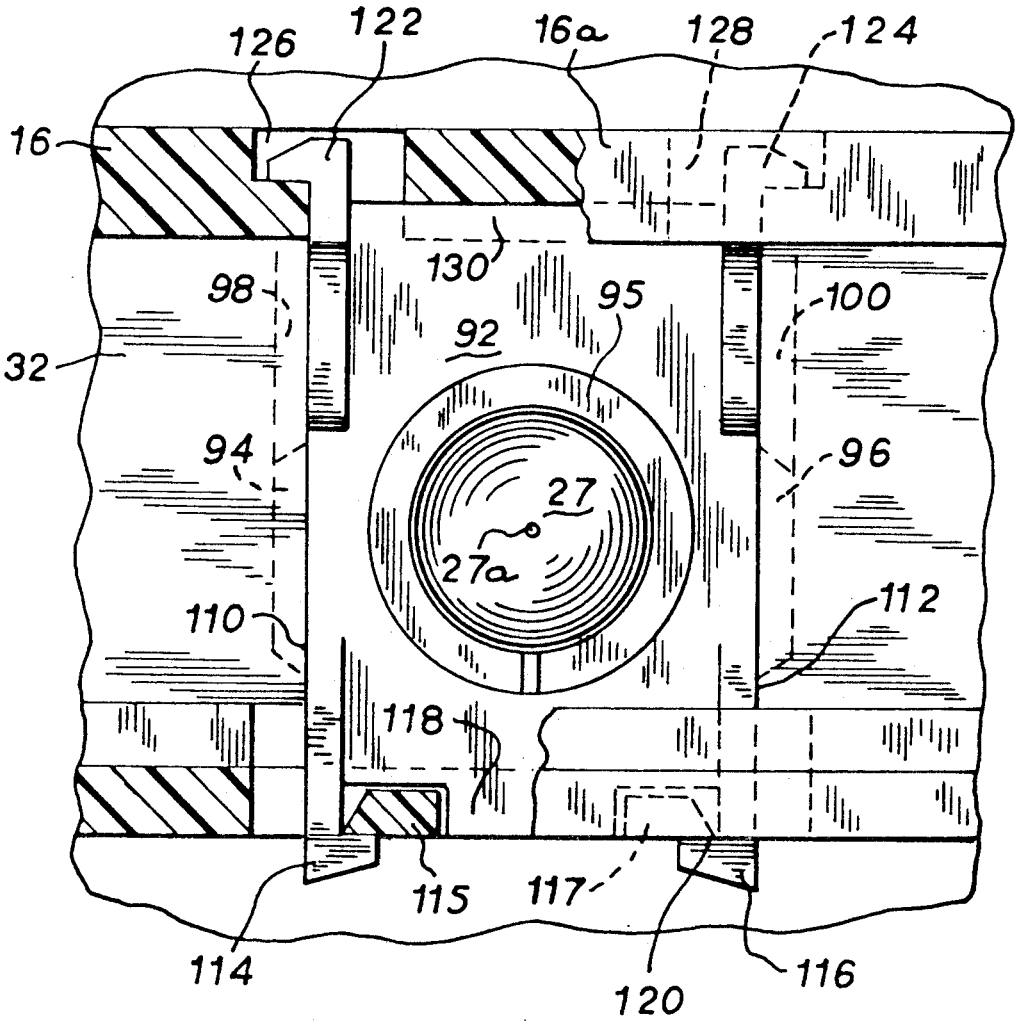
FIG. 8

INTEGRAL ENGINE HOUSING

BACKGROUND OF THE INVENTION

This invention relates to internal combustion engines, and more particularly to plastic housings for such engines.

Small internal combustion engines—such as those used with lawnmowers, snowblowers, generators and the like—typically have a number of distinct components or housings for key parts of the engine. For example, the fuel tank is typically a separate component from the air filter housing. Similarly, the blower housing—which includes the air passageway through which forced air passes to cool the engine—is typically a separate component.

Each of these distinct components must be separately manufactured and assembled, greatly increasing the cost of the completed engine. Moreover, additional parts are typically required when these housings are distinct units. For example, a fuel line is needed between the fuel tank and the carburetor. Also, a flexible hose is often used between the air filter outlet and the air intake of the carburetor or other air/fuel mixing device. The use of these additional components also increases the cost in manufacturing and assembling the completed engine.

Since internal combustion engines by their very nature generate a great deal of heat, it has often been necessary to manufacture many of the engine components, such as the fuel tank, from metal materials due to the metal's ability to withstand the high temperatures generated by the engine. Since metal is expensive and requires a number of separate forming, punching and machining steps, the use of metal materials also increases the cost in manufacturing and assembling the component parts.

SUMMARY OF THE INVENTION

An integral plastic engine housing for an internal combustion engine is disclosed wherein a number of previously-distinct engine components are formed as a single unit to reduce manufacturing and assembly cost. The integral housing is preferably made of an inexpensive plastic material such as high density polyethylene.

In a preferred embodiment, the integral housing includes: a fuel tank; a blower housing that includes an air passageway for air cooling of the engine; an air filter housing having an inlet opening, an outlet opening, and an air filter element; a fuel primer bulb assembly including a primer bulb; a top wall over the entire integral housing that forms at least a part of an upper side of the fuel tank, the blower housing and the air filter housing; and an exterior side wall that forms at least a part of a lateral side wall of the fuel tank, the blower housing, and the air filter housing.

The integral primer bulb assembly preferably includes a primer bulb housing having rails which fit into tapered grooves in the exterior side wall, a snap fastener which retains the air filter cover, and a snap ring which secures the primer bulb against the bulb housing.

The integral engine housing preferably also includes an integral air/fuel mixing device such as a carburetor or fuel injector. The air/fuel mixing device is preferably made of nylon and is attached to the rest of the integral housing by a connection means. The connection means preferably includes a first rail interconnected with the air filter housing and a first slide member interconnected with the mixing device and having a first groove therein such that the first slide member slides on the first rail to connect the mixing device to the air filter housing. The connection means may also include a second rail interconnected with the air filter housing and a second slide member interconnected with the mixing device and having a second groove therein, whereby the second slide member slides on the second rail to connect the mixing device to the air filter housing.

A locking means may also be provided for preventing the disconnection of the air/fuel mixing device from the air filter housing. The locking means preferably includes a resilient tab interconnected with the first rail that moves in a first or a downward direction when the slide member is sliding on the rail and that moves in a second or upward direction to lockingly engage the first slide member when the mixing device is connected to the air filter housing to prevent further movement by the slide member. The locking means may include a second resilient tab interconnected with said second rail that lockingly engages the second slide member.

The air/fuel mixing device preferably includes an air intake that, together with a sealing means, forms a sealed passageway with an intake elbow attached to the air filter housing outlet. In addition, the air/fuel mixing device preferably includes an integral fuel line having a flange that engages a side wall of the fuel tank, thereby avoiding the need for a separate fuel line component.

The integral plastic housing may incorporate a number of previous separate components to further minimize manufacturing and assembly costs. The integral housing may include a starter rewind housing for enclosing the starter rewind mechanism. The starter rewind housing is preferably interconnected with the top wall of the integral housing by means of a plurality of dog legs that fit into slots in the top wall. The integral plastic housing may also include an integral brake cover to protect the brake mechanism from the environment.

Although the components of the integral engine housing may be arranged in a variety of ways, one particularly desirable arrangement has the fuel tank and the air filter housing sharing a common interior side wall and thus being adjacent to each other. The fuel tank and the blower housing may also share a common interior side wall, as do the air filter housing and the blower housing. The air/fuel mixing device is preferably positioned adjacent to and beneath the air filter housing to minimize the distances between the fuel tank and the mixing device as well as between the air filter housing and the mixing device. The brake cover is preferably located on the opposite side of the fuel tank from the air filter element, and also shares a common interior side wall with the fuel tank.

It is a feature and advantage of the present invention to provide an integral engine housing made substantially completely from a low cost plastic material to reduce the cost of a small, internal combustion engine.

It is yet another feature and advantage of the present invention to provide an integral engine housing to reduce the number of assembly steps required in manufacturing an internal combustion engine.

It is yet another feature and advantage of the present invention to provide an integral plastic engine housing which substantially reduces the engine's cost by eliminating the fuel line, air hoses, and the clamps normally needed to connect fuel lines and air hoses to their respective housings.

It is yet another feature and advantage of the present invention to reduce the cost of an internal combustion engine by using common walls for different components, thereby eliminating extra side walls required in prior art devices.

These and other features and advantages of the present invention will be apparent to those skilled in the art from the following detailed description of the preferred embodiment and the attached drawings, in which:

BRIEF DESCRIPTION OF THE DRAWINGS

FIG. 2 is a top view of the integral engine housing wherein the starter rewind housing, fuel tank cap, air filter cover, and primer bulb assembly have been removed.

FIG. 3 is a cross-sectional view of the integral engine housing of FIG. 2, taken along line 3—3.

FIG. 7 is a top view, shown in partial section, of an integral primer bulb assembly according to the present invention.

FIG. 8 is a front view, shown in partial section, of the integral primer bulb assembly of FIG. 7.

DETAILED DESCRIPTION OF PREFERRED EMBODIMENTS

The integral engine housing according to the present invention is specifically designed for small internal combustion engines such as those used with lawnmowers. snowblowers and the like. In the present invention, a number of otherwise distinct components or housings have been combined into a single unit to decrease the costs of manufacturing and assembly. Specifically, the fuel tank, the air filter housing, the blower housing, the starter rewind housing, the carburetor, the fuel primer for the carburetor, and a cover for the brake are integrated into a single unit as described below.

As used herein, the term "blower housing" refers to that passageway through which forced air from the engine blower or fan travels to air cool the engine. The term "starter rewind housing" as used herein refers to that part used to enclose the starter rewind mechanism of the engine onto which the engine pull-rope is wound.

Figure 1:
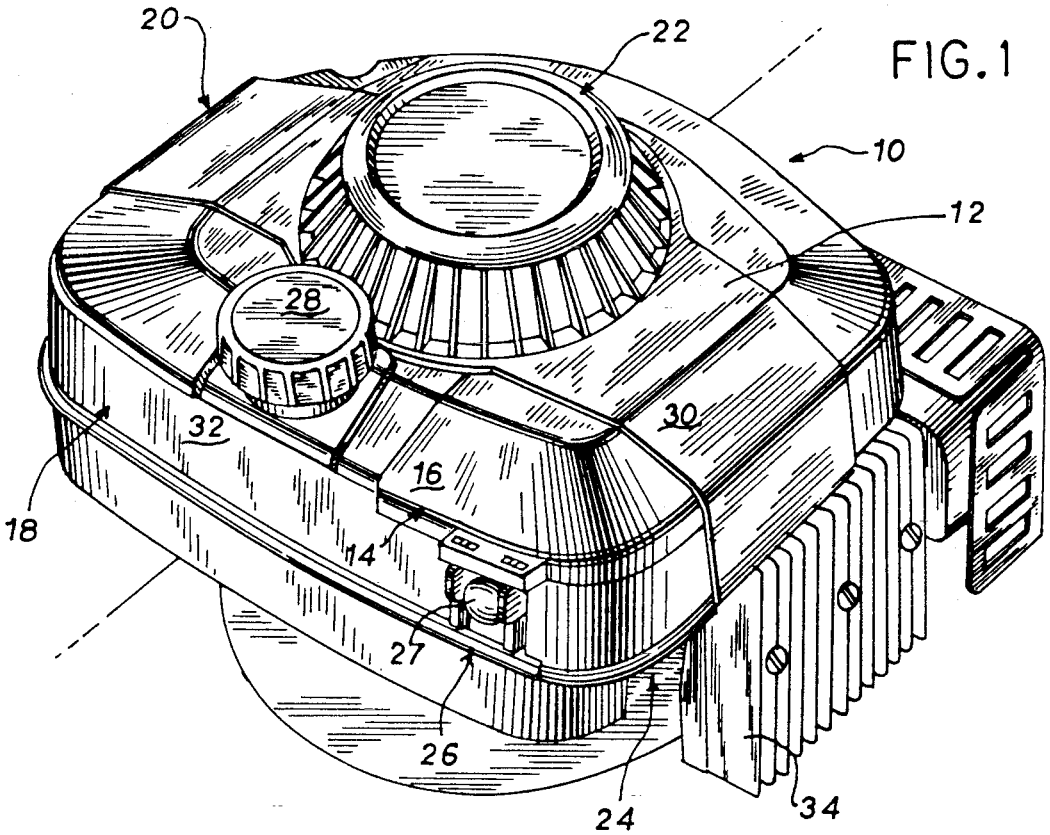
FIG. 1 is a perspective view of the integral engine housing according to the present invention.

FIG. 1 is a perspective view of an integral engine housing 10 according to the present invention. In FIG. 1, integral housing 10 includes a blower housing 12, an air filter housing 14 having a removable cover 16, an adjacent fuel tank 18, a brake cover 20, a starter rewind housing 22, a carburetor 24, and a fuel primer bulb assembly 26 having a primer bulb 27 that is depressed before engine starting to pump fuel into the carburetor. Although the preferred embodiment of the integral housing 10 includes a carburetor, it should be understood that other types of air/fuel mixing devices such as fuel injectors and the like may be used in place of carburetor and are within the contemplated scope of the present invention. Fuel tank 18 has a removable cap 28 through which fuel is poured to fill the fuel tank.

The integral housing 10 depicted in FIG. 1 includes a top wall 30 that forms at least a portion of the upper side of each of blower housing 12, air filter housing 14, fuel tank 18 and brake cover 20. Top wall 30 may be substantially continuous, or it may have discontinuities or removable components such as cover 16 of the air filter housing.

Integral housing 10 also includes an exterior side wall 32 that forms at least a part of a lateral side wall of fuel tank 18, blower housing 12, air filter housing 14 and brake cover 20. Exterior side wall 32 is also preferably substantially continuous although it may have discontinuities or openings therein as for example the opening that receives primer bulb assembly 26.

In any case, top wall 30 and exterior side wall 32, along with starter rewind housing 22, substantially define the upper and lateral sides of integral housing 10. Integral housing 10 rests on engine 34 as depicted in FIG. 1.

FIG. 2 is a top view of integral housing 10 of FIG. 1 except that those components which may be removed from integral housing 10 are not shown. That is, starter rewind housing 22 is not shown in FIG. 2, although slots 35 are shown which receive the dog leg tabs of starter rewind housing 22. Top cover 16 has also been removed from air cleaner housing 14 as has the air cleaner element itself. Primer bulb assembly 26 has also been removed to reduce the complexity of the drawing.

Figure 5:
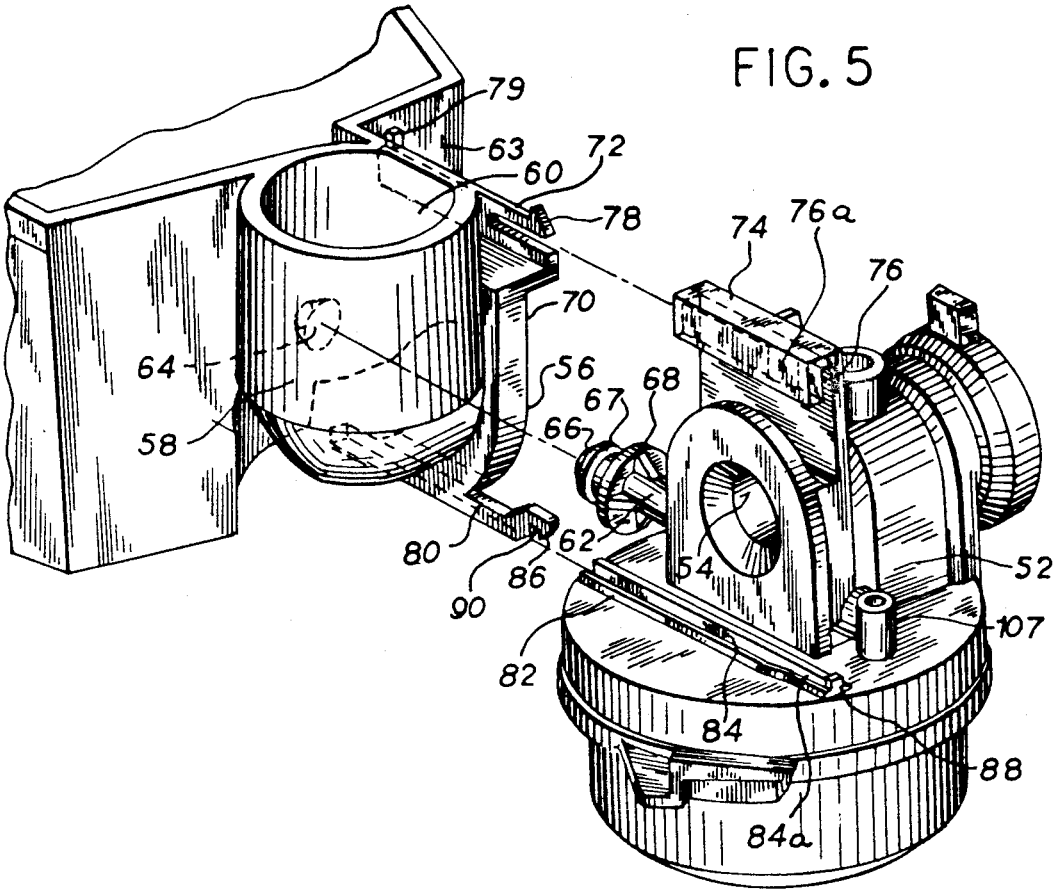
FIG. 5 is a perspective view depicting the connection means by which a carburetor is connected to the intake elbow of the air cleaner housing.
Figure 6:
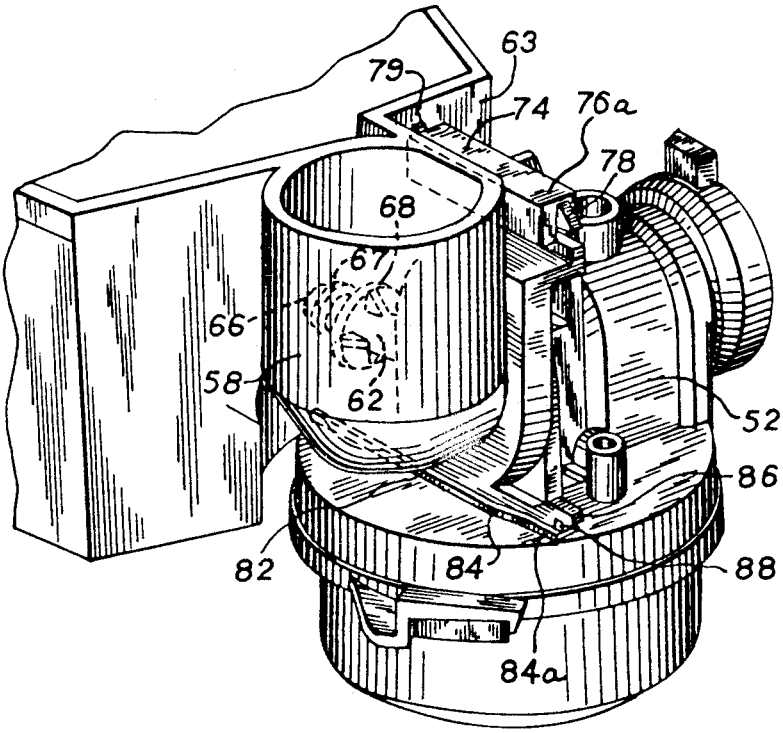
FIG. 6 is a perspective view depicting the integral carburetor connected to the intake elbow.

Air cleaner housing 14 is conventional, having a base 37 and a carburetor air inlet tube 39 disposed between cover 16 and a bottom surface 41 of base 37. Base 37 also includes sealing side walls 43 that surround the air cleaner element and slots 45 in bottom surface 41 through which ambient intake air passes. The ambient intake air is filtered by the air cleaner element and then passes through tube 39 to intake elbow 58 and then to carburetor air intake 54 (FIGS. 5 and 6).

As also shown in FIG. 2, blower housing 12 and air cleaner housing 14 are separated by a common lateral side wall 36, shown in phantom. Also, fuel tank 18 is separated from blower housing 12 by a common lateral side wall 38, shown in phantom. Brake cover 20 is separated by a common interior lateral side wall 40 from blower housing 12, and brake cover 20 is separated from fuel tank 18 by a common interior lateral side wall 47. The use of common interior side walls minimizes the number of side walls which must be molded, thereby reducing manufacturing costs.

The integral plastic housing is preferably made from a mixture containing high density polyethylene, although other plastic materials may be used. The integral air/mixing device according to the present invention is preferably made from nylon plastic.

FIG. 3 is a cross-sectional view of integral plastic housing 10 shown in FIG. 2, taken along line 3-3. As shown in FIG. 3, blower housing 12 is separated from brake cover 20 by an interior lateral side wall 40. The starter rewind housing 22 (FIG. 1) fits on starter rewind flange 42 depicted in FIG. 3.

Figure 4:
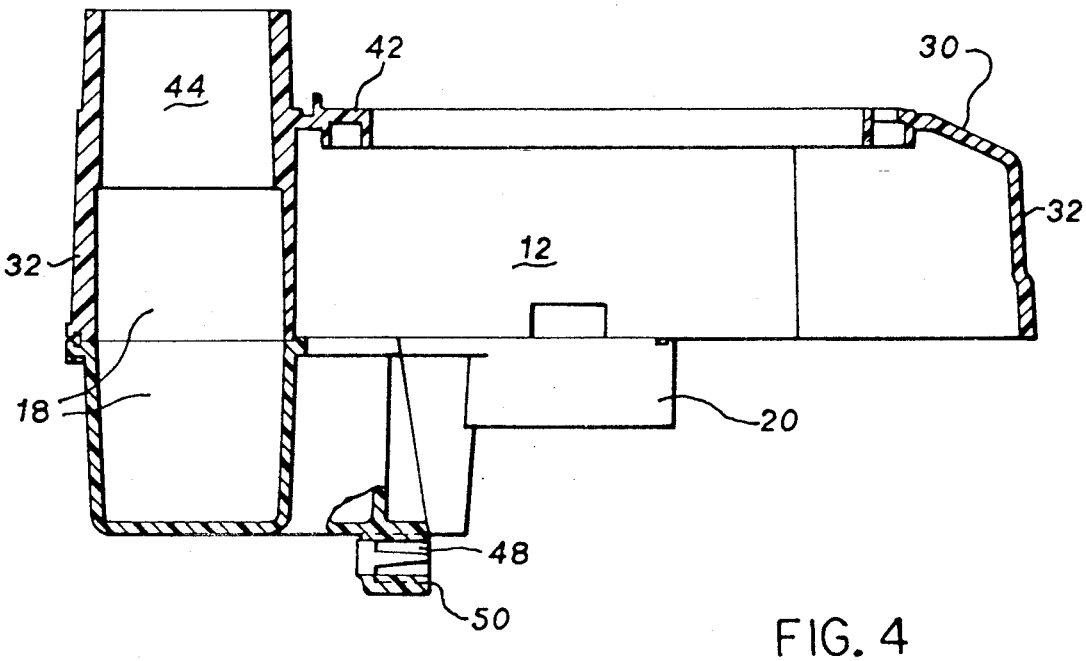
FIG. 4 is a cross-sectional view of the integral engine housing of FIG. 2, taken along line 4—4.

FIG. 4 is another cross-sectional view of the integral housing depicted in FIG. 2, taken along line 4—4. In FIG. 4, threaded fill spout 44 provides a conduit for fuel that is poured into fuel tank 18. A portion of brake cover 20 extends below blower housing 12 as shown in FIG. 4. Integral housing 10 is attached to engine 34 via four mounting bosses 48, three of which are shown in FIG. 2 and a fourth mounting boss being shown in FIG. 4. Mounting bosses 48 preferably include a metal sleeve 50 therein to provide a secure attachment between the plastic integral housing and the metal engine casing.

Metal sleeves 50 are properly positioned relative to each other by using an assembly fixture (not shown) that also insures that the sleeves are aligned with the mounting bosses (not shown) on engine 34. Four bolts (not shown), one for each mounting boss 48, are used to attach integral housing 10 to engine 34.

As shown in FIGS. 5 and 6, integral housing 10 may also include an integral air/fuel mixing device such as carburetor 52. The air intake 54 of carburetor 52 is interconnected with an outlet opening 56 on intake elbow 58 via a connection means to be discussed below. Intake elbow 58 is interconnected with and is a part of air cleaner housing 14. Intake elbow 58 receives filtered air through its inlet opening 60 from the air filter element, and passes the filtered air through opening 56 into intake 54 of carburetor 52.

Thus, filtered air is transmitted directly from the air cleaner housing to air intake 54 of carburetor 52 without the need for additional hoses and their associated clamps. A sealing means consisting of an O-ring seal 70 on intake elbow 58 seals the junction between the outlet of the intake elbow and air intake 54 of the carburetor.

Carburetor 52 also includes an integral fuel line 62 which is directly connected to the fuel tank via an aperture 64 in the fuel tank and a flange 66 on fuel line 62. Flange 66 passes through aperture 64 and abuts a wall 63 of the fuel tank to prevent disconnection. Shoulder 68 on fuel line 62, together with flange 66, prevent movement of the fuel line relative to fuel tank wall 63. Shoulder 68 abuts the exterior of the fuel tank wall. A sealing means, consisting of an O-ring seal 67 on fuel line 62, seals the junction between shoulder 68 and fuel tank wall 63. Fuel is thus directly transmitted from the fuel tank to the fuel intake of carburetor 52 via fuel line 62 without need for additional fuel lines or hoses and their accompanying clamps.

A connection means is used to connect carburetor 52 to air filter housing 14 and thus to integral plastic housing 10. The connection means may have a variety of forms, and is designed to substantially permanently connect the air/fuel mixing device to the remainder of the integral plastic housing and to keep the components in proper alignment.

In the preferred embodiment depicted in FIGS. 5 and 6, the connection means consists of a plurality of rails and associated slide members. Specifically, the connection means includes a first rail 72 interconnected with air filter housing 14 and a corresponding first slide member 74 interconnected with carburetor 52. Slide member 74 has a groove 76 therein which slides on first rail 72 to connect carburetor 52 to the air filter housing.

Slide member 74 is locked onto first rail 72 via a locking means which preferably consists of a resilient tab 78. Tab 78 moves in a downward or first direction when first slide member 74 is sliding on first rail 72 since it is depressed by slide member 74. After slide member 74 has slid onto first rail 72 and abuts shoulder 79, tab 78 moves in an upward or second direction to prevent the movement of first slide member 74.

The connection means also includes a second rail 80 interconnected with the air filter housing and a corresponding second slide member 82 having a second groove 84 therein. Second rail 80 slides in second groove 84 until tab 86, attached to second rail 80, encounters a shoulder 88 at the end of second groove 84. Due to the tapered shape of tab 86, the tab will move in an upward direction when it encounters shoulder 88 until slot 90 in tab 86 fits over shoulder 88 to lock second rail 80 in place. This locking engagement is more clearly shown in FIG. 6, as is the locking engagement between the first rail and the first slide member.

The widths of grooves 76 and 84 are chosen such that there is adequate clearance between the rails 72 and 80 on the one hand and slide members 74 and 82 on the other hand to prevent rolling of O-ring seal 70 during assembly. Grooves 76 and 84 are tapered near their ends **76*a* and 84*a*** respectively that are furthest from the air filter housing, to provide a tight seal between the rails, O-ring, and slide members at the point of locked engagement.

FIG. 6 depicts carburetor 52 being connected to the remainder of the integral plastic housing. As shown in FIG. 6, the locking means, including resilient tabs 78 and 88, prevents the disconnection of carburetor 52 from air cleaner housing 14. FIG. 6 also depicts the connection between integral fuel line 62 and the fuel tank via flange 66 and shoulder 68 as discussed above.

FIGS. 7 and 8 depict primer bulb assembly 26 of FIG. 1. The primer bulb both provides priming fuel to the carburetor and acts as the carburetor bowl vent. In FIGS. 7 and 8, primer bulb assembly 26 includes a primer bulb 27 that is fixed in position by a primer bulb housing 92 and by a snap ring 95. Housing 92 has a pair of opposed rails 94 and 96 which fit into respective grooves 98 and 100 in exterior side wall 32. Housing 92 also has two opposed grooves 102 and 104 into which snap ring 95 is fitted. Housing 92 has a burr connector 106 to which one end of a tube (not shown) is connected. The other end of the tube is connected to the carburetor at tubular fitting 107 (FIG. 5). Burr 106 has an air passageway 108 therein. Primer bulb 27 has a vent hole **27*a*** therein through which the carburetor bowl is vented.

As best shown in FIG. 8, the downward movement of housing 92 is stopped when rails 94 and 96 reach their respective stops 110 and 112 at the lower ends of grooves 98 and 100 respectively. Grooves 98 and 100 are preferably tapered to provide an interference fit with their respective rails 94 and 96.

Housing 92 also has two one-way connectors 114 and 116 which connect the primer bulb assembly to the bottom of integral plastic housing 10. Connectors 114 and 116 engage snap fasteners 115 and 117 respectively which are integral with housing 10. Housing 92 also has a lower rail 118 which fits into a groove 120 in housing 10 to further secure housing 92 to housing 10. Housing 92 should be made from a material capable of sealing bulb 27, such as nylon.

Housing 92 also has two opposed snap fasteners 122 and 124 which fit into apertures 126 and 128 respectively in air filter cover 16. Snap fasteners 122 and 124 are pressed towards each other to permit air filter cover 16 to be removed or replaced. Housing 92, including its snap fasteners 122 and 124 and its connectors 114 and 116, must be made from a material capable of withstanding many uses such as nylon. A rail **16*a* on cover 16 fits into a corresponding upper groove 130 in housing 92 to further secure cover 16** in its proper position.

Although FIGS. 1, 7 and 8 depict one suitable primer bulb assembly which may be used with the present invention, other primer bulb assemblies may also be used. For example, the primer bulb assembly disclosed in U.S. Pat. No. 5,070,829 issued Dec. 10, 1991 to Guntly et al, which is incorporated by reference herein, may be readily adapted for use with the present invention.

Although a particular preferred embodiment of the present invention has been shown and described, other alternate embodiments will be apparent to those skilled in the art and are within the intended scope of the present invention. Therefore, the invention is to be limited only by the following claims.

We claim:

1. An integral housing for an internal combustion engine, comprising:

a fuel tank;

a blower housing that includes an air passageway;

an air filter housing having an inlet opening and an outlet;

a top wall that forms at least a part of an upper side of each of said fuel tank, said blower housing, and of said air filter housing; and an exterior side wall that forms at least a part of a lateral side wall of each of said fuel tank, said blower housing, and of said air filter housing.

2. The integral housing of claim further comprising:

connection means for connecting an air/fuel mixing device to said air filter housing.

3. The integral housing of claim 2, wherein said connection means comprises:

a first rail interconnected with said air filter housing; and a first slide member interconnected with said mixing device and having a first groove therein, said first slide member sliding on said first rail to connect said mixing device to said air filter housing.

4. The integral housing of claim 3, wherein the width of said first groove is tapered near a first groove end that is furthest from said air filter housing.

5. The integral housing of claim 3, further comprising:

a resilient tab interconnected with said first rail that moves in a first direction when said slide member is sliding on said and that moves in a second direction to lockingly engage said first slide member when said mixing device is connected to said air filter housing.

6. The integral housing of claim 3, wherein said air filter housing includes an intake elbow interconnected with an output of said air filter housing, and wherein said first rail is interconnected with said intake elbow and said first slide member is interconnected with said air/fuel mixing device.

7. The integral housing of claim 3, further comprising:

a second rail interconnected with said air filter housing; and a second slide member interconnected with said mixing device and having a second groove therein, said second slide member sliding on said second rail to connect said mixing device to said air filter housing.

8. The integral housing of claim 7, wherein the width of said second groove is tapered near a second groove end that is furthest from said air filter housing.

9. The integral housing of claim 2, further comprising:

locking means for preventing the disconnection of said mixing device from said air filter housing.

10. The integral housing of claim 9, wherein said locking means includes a resilient tab.

11. The integral housing of claim 1, wherein said air filter housing includes an intake elbow interconnected with an outlet of said air filter housing.

12. The integral housing of claim 11, further comprising:

an air/fuel mixing device having an air intake; and sealing means for sealing the junction between said intake elbow and said air intake.

13. The integral housing of claim further comprising:

an air/fuel mixing device; and connection means for connecting said air/fuel mixing device to said air filter housing and to said fuel tank.

14. The integral housing of claim 13, wherein said air filter housing outlet includes an intake elbow, and wherein said air/fuel mixing device includes an air intake that is connected to said intake elbow by said connection means.

15. The integral housing of claim 13, wherein said air/fuel mixing device includes an integral fuel line that is connected to said fuel tank by said connection means.

16. The integral housing of claim 15, wherein said integral fuel line has a flange that engages a side wall of said fuel tank.

17. The integral housing of claim 13, wherein said air/fuel mixing device is made of a plastic material containing nylon.

18. The integral housing of claim 1, wherein said fuel tank and said air filter housing have a common interior side wall.

19. The integral housing of claim 1, wherein said fuel tank and said blower housing have a common interior side wall.

20. The integral housing of claim 1, wherein said air filter housing and said blower housing have a common interior side wall.

21. The integral housing of claim 1, further comprising:

a brake cover that protects a brake from the environment.

22. The integral housing of claim 21, wherein said brake cover and said fuel tank have a common interior side wall.

23. The integral housing of claim 21, wherein said brake cover and said blower housing have a common interior side wall.

24. The integral housing of claim 1, wherein said integral housing is made from a mixture containing high density polyethylene.

25. The integral housing of claim 1, further comprising:

a starter rewind housing interconnected with said top wall.

26. The integral plastic housing of claim 1, further comprising:

a primer bulb assembly that is interconnected with said exterior side wall.

27. The integral plastic housing of claim 26, wherein said primer bulb assembly includes a primer bulb;

means for retaining said primer bulb in a fixed position; and means for connecting said retaining means to said exterior side wall.

28. The integral plastic housing of claim 27, wherein said air filter housing includes an air filter cover, and wherein said primer bulb assembly includes a fastener means for fastening said air filter cover to said primer bulb assembly.

29. The integral plastic housing of claim 27, wherein said retaining means includes:

a primer bulb housing having at least one groove therein; and a snap ring that engages said groove.

30. The integral plastic housing of claim 27, wherein said connecting means includes:

at least one rail member attached to said retaining means; and a groove in said exterior side wall adapted to receive said at least one rail member.

* * * * *

UNITED STATES PATENT AND TRADEMARK OFFICE

CERTIFICATE OF CORRECTION

PATENT NO. : 5,197,426

DATED : March 30, 1993

INVENTOR(S) : Frangesch et al

It is certified that error appears in the above-identified patent and that said Letters Patent is hereby corrected as shown below:

CLAIM 2, Col. 7, Line 20, after "claim" insert ----1,----; CLAIM 5, Col. 7, Line 38, after "said" insert ----rail,----; CLAIM 13, Col. 8, Line 6, after "claim" insert ----1,----; CLAIM 27, Col. 8, Line 56, after "includes" insert ----:----;

Signed and Sealed this

Fourth Day of January, 1994

*Attest:*

*Attesting Officer*

BRUCE LEHMAN

*Commissioner of Patents and Trademarks*